US006111510A

United States Patent [19]

Coffelt, Jr.

[11] Patent Number: 6,111,510

[45] Date of Patent: Aug. 29, 2000

[54] METHOD OF DROWNING DETECTION

[76] Inventor: Louis Arthur Coffelt, Jr., 5297 Loma, Mira Loma, Calif. 91752

[21] Appl. No.: 09/396,063

[22] Filed: Sep. 15, 1999

[51] Int. Cl.[7] ..... G08B 23/00

[52] U.S. Cl. ..... 340/573.6; 340/573.1; 340/539; 340/604

[58] Field of Search ..... 340/573.6, 573.1, 340/539, 604; 367/131, 141, 604

[56] References Cited

U.S. PATENT DOCUMENTS 4,747,085 5/1988 Dunegan et al. ..... 367/93
5,146,208 9/1992 Parra ..... 340/573
5,907,281 5/1999 Miller, Jr. et al. ..... 340/573.6
5,959,534 9/1999 Campbell et al. ..... 340/573.6

*Primary Examiner*—Jeffery A. Hofsass
*Assistant Examiner*—Hung Nguyen

[57] ABSTRACT

The disclosed invention, a method of drowning detection, comprising the utilization of inherent sound waves emitted from a living person. A Central Processing Unit (CPU) detects a first event; the presence of a first bodily function. Said CPU detects a second event; the absence of a second bodily function. Said CPU counts a quantity of time, wherein said first and second event occur simultaneously.

3 Claims, No Drawings

METHOD OF DROWNING DETECTION

CROSS REFERENCE TO RELATED APPLICATIONS not applicable

STATEMENT OF FEDERALLY SPONSORED RESEARCH DEVELOPMENT not applicaple

REFERENCE TO A MICROFICHE APPENDIX not applicable

BACKGROUND OF THE INVENTION

The possibility of a person drowning in a swimming pool is unfortunately well-known. There are several devices that attempt to prevent this tragedy. These prior art devices contribute a ceratin degree of safety. Some require implementation of a portable device. Obviously there are possible situations which may cause these devices to become inoperative.

It is known, time is of the essence in helping a drowning victim. The disclosed Method of drowning detection provides the ability to reliably and immediately activate any desired alarm in the event drowning is detected.

BRIEF SUMMARY OF THE INVENTION

A method of drowning detection comprising the steps of:

(1.) A Central Processing Unit (CPU) detecting the presence of inherent sound waves emitted from a beating Heart.

(2.) Said CPU detecting the absence of inherent sound waves emitted from Inhalation.

(3.) Utilizing;

(a.) The information obtained in step (1.).

(b.) The information obtained in step (2.).

(c.) Well-known logic.

to count a predetermined quantity of time.

Generally, electronic combinational logic circuits are programmed such that said circuits respond to particular inputs. Wherein said inputs represent said two inherent sound waves. With the ability to continuously monitor the presence and absence of said sound waves. And using logical reasoning, drowning can easily be determined.

BRIEF DESCRIPTION OF THE SEVERAL VIEWS OF THE DRAWING not applicable

DETAILED DESCRIPTION OF THE INVENTION

The present invention resides in a method of drowning detection. It is unfortunately well-known, accidental drowning occurs in swimming pools, and similar bodies of water.

It is well-known, water is an excellent conductor of sound waves. Therefor, the disclosed method of drowning detection can be achieved by the steps comprising:

(1.) A transducer placed in close proximity with a body of water.

For example: a swimming pool, jacuzzi, or bathtub.

(2.) Said transducer coupled to a Central Processing Unit (CPU).

For example: a computer.

(3.) A living person having contact with said water.

(4.) Said transducer continuously converts sound waves into a transmittable signal. Said signal transmitted to said CPU.

(5.) Said CPU continuously analyzes said signal.

(6.) Said analysis determines the presence of a first inherent sound wave emitted from a living person.

For example: A sound wave emitted from a beating Heart.

(7.) Said analysis determines the absence of a sound wave emitted from an oscillating Respiratory System.

For example: A sound wave emitted from Inhalation of air into Lungs.

(8.) IF steps (6.) and (7.) occur simultaneously:

Said CPU counts the quantity of time said simultaneous event occurs.

(9.) IF said quantity reaches a predetermined number: Said CPU turns on an alarm.

For example: Thirty-five seconds, or Thirty seconds.

(10.) IF said CPU determines the presence of sound waves emitted from an oscillating Respiratory System:

Said count resets to zero.

Sound waves are typically within the well-known range of frequencies (approximately 20 Hertz to approximately 20 K Hertz).

Particular sounds are a composite wave formed of a fundamental frequency and various harmonics. These harmonics make it possible to distinguish the source of a particular sound wave. It is well-known the human ear can distinguish the difference between the sound of Inhalation and a beating Heart. It is also well-known, there are computer programs designed for sound recognition of the human voice.

For example:

(a.) Recognition of the Letters "A" through "Z".

(b.) Recognition of the words "yes" and "no".

(c.) Recognition of the numbers "0" through "9".

A computer program can easily be formed to recognize the respective distinct sound produced by Inhalation and a beating Heart.

An example of a transducer is a microphone. And the possible methods of communication and amplification of signals between a CPU and a transducer are well-known by those experienced in the art.

It is obvious the presence of sound waves emitted from a beating Heart requires the presence of sound waves emitted from a Respiratory System. This system may be adapted to simultaneously recognize the presence of more than one person. Thereby having the capability to simultaneously determine drowning of two or more persons. It may be found there are other suitable sound waves which indicate the desired parameters. Therefore the present invention is not limited to the specific sound waves described herein.

There is an obvious maximum amount of time a person can abstain from breathing. And said maximum can vary depending on age and other factors. Said CPU can be programmed to indicate drowning at a desired quantity of time.

For example:

(a.) Thirty-five seconds.

(b.) Thirty seconds.

(c.) Twenty seconds.

The advantages of detecting drowning as soon as possible are obvious.

There are various commercially available devices that can be employed in conjunction with the present invention. And there are well-known logical scenarios which occur in bodies of water. Said scenarios can be employed in conjunction with the present invention.

Obviously, many modifications and variations of the present invention, as hereinbefore set forth, may be made without departing from the spirit and scope thereof, and therefor, only such limitations should be imposed as are indicated by the appended claims.

I claim:

1. A method of drowning detection comprising the steps of:

(i) Detecting the presence of inherent sound waves emitted from a first bodily function in a body of water;

(ii) Detecting the absence of inherent sound waves emitted from a second bodily function in a body water;

(iii) Utilizing step (i) and step (ii) to count a quantity of time.

2. The method of drowning detection according to claim 1, wherein said first bodily function is heating Heart.

3. The method of drowning detection according to claim 1, wherein said second bodily function is breathing Respiratory System.

* * * * *

UNITED STATES PATENT AND TRADEMARK OFFICE

CERTIFICATE OF CORRECTION

PATENT NO. : 6,111,510

DATED : Aug. 29, 2000

INVENTOR(S) : Louis Arthur Coffelt, Jr.

It is certified that error appears in the above-identified patent and that said Letters Patent is hereby corrected as shown below:

Title page, item 75, in the Inventor, line 1, after "5297", the street name reading "Loma", should read --Martin Street--.

In the Claims, Claim 2, line 2, after "function is", the word reading "heating", should read --beating--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*